United States Patent [19]

Anderson

[11] 4,039,186

[45] Aug. 2, 1977

[54] GAME APPARATUS

[76] Inventor: Paul R. Anderson, 23701 Surf Cove, Laguna Niguel, Calif. 92677

[21] Appl. No.: 665,929

[22] Filed: Mar. 11, 1976

[51] Int. Cl.[2] ..... A63F 9/00

[52] U.S. Cl. ..... 273/1 R; 273/97 R

[58] Field of Search ..... 273/1 R, 1 A, 58 C, 273/67 R, 84 R, 97 R, 98

[56] References Cited

U.S. PATENT DOCUMENTS

| | | | |
|---|---|---|---|
| 1,334,188 | 3/1920 | Swan | 273/84 R |
| 1,944,628 | 1/1934 | Barker | 273/97 R |
| 2,089,652 | 8/1937 | Kelly | 273/97 R |
| 2,376,755 | 5/1945 | Buckner | 273/97 R |
| 3,139,281 | 6/1964 | Nicholson | 273/1 A |
| 3,494,618 | 2/1970 | Kramer | 273/98 |
| 3,674,264 | 7/1972 | Boercker | 273/1 R |
| 3,879,034 | 4/1975 | Petrusek | 273/1 R |
| D. 91,422 | 1/1934 | Fisher | 273/97 R UX |

*Primary Examiner*—William H. Grieb
*Attorney, Agent, or Firm*—William I. Beach

[57] ABSTRACT

Game apparatus for playing a game is provided requiring skill, dexterity and body motion. The game apparatus comprises a sheet of fabric, plastic or the like, adapted to lay on a flat surface and tread on by one or more players. The upper surface of the sheet is imprinted with graphic symbols for guiding and scoring the player. To advance to scoring position the player is required to grasp a tethered ball device and cast the ball into the air so as to loop it through an aperture extending through the tethered ball device.

9 Claims, 4 Drawing Figures

FIG. 1
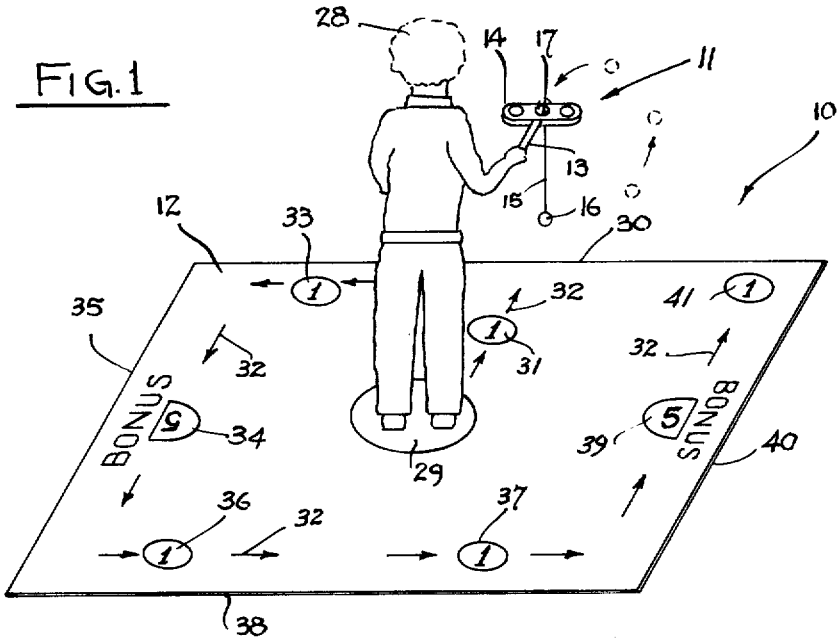
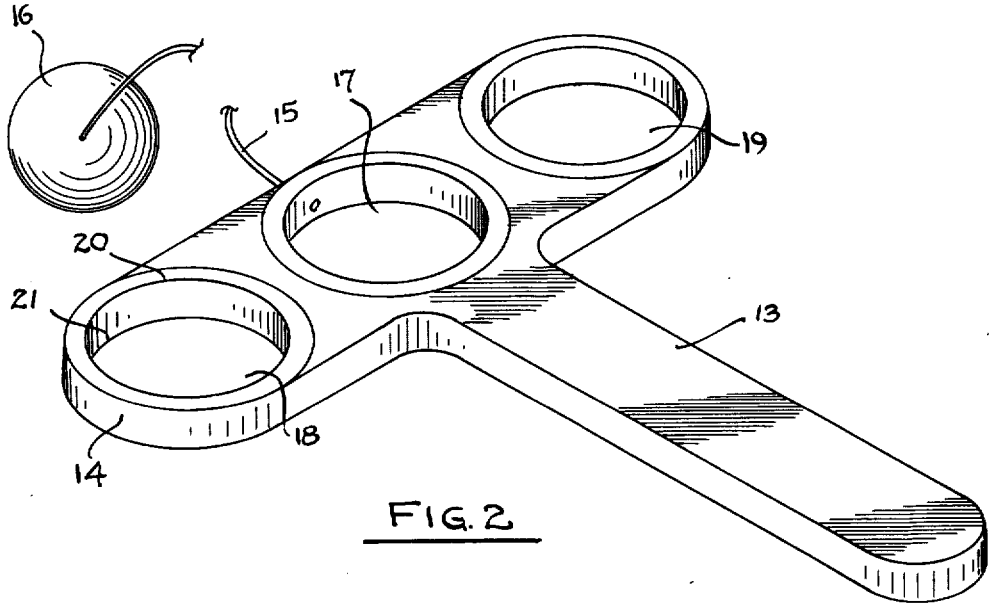
FIG. 2
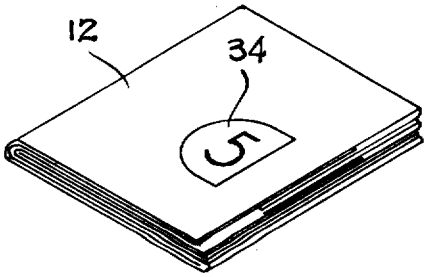
FIG. 4
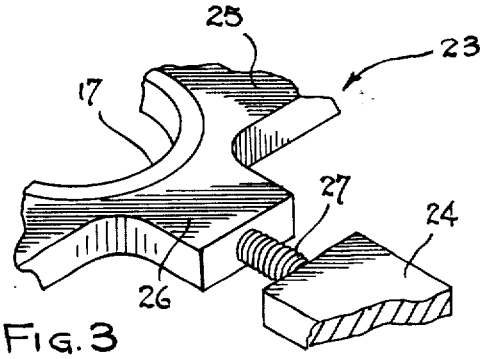
FIG. 3

GAME APPARATUS

BACKGROUND OF THE INVENTION

1. Field of the Invention

The present invention relates to game apparatus for playing games and more particularly to games requiring concentration, dexterity and physical activity.

2. Description of the Prior Art

By and large games designed for amusement generally consist of a game board, dice, chips, cards or the like to play the game. Such games depend almost entirely upon chance whereupon a lucky roll of the dice, drawn card or the spin of the pointer on a dial dictates a directional move on the game board. The players sit around the game board and take part in little or no physical exertion.

Therefore, it is the object of the present invention to provide game apparatus which requires a player to display exceptional dexerity and physical exertion or activity to start and complete the game.

SUMMARY OF THE INVENTION

In carrying out the principles of the present invention in accordance with a preferred embodiment thereof, a game apparatus includes a tee-shaped body which is constructed for holding in the hand of a player. The tee-shaped body consists of a handle flexibly connected to a crossmember having an aperture therethrough. A cord is secured at one end to the crossmember and the other end to a ball. The ball is adapted to be cast in the air and looped through the aperture. A game sheet is provided which is adapted for standing and walking on. The upper surface of the sheet is delineated with a starting area, intermediate scoring areas and a finishing area. The object of the game is that the player must cast and loop the ball successively through the aperture before moving on to each scoring area.

BRIEF DESCRIPTION OF THE DRAWING

FIG. 1 is a perspective view of the game apparatus embodying the present invention, FIG. 2 is a perspective view of the tee-shaped body of the present invention, FIG. 3 is a fragmented perspective view of a modified form of the tee-shaped body shown in FIG. 2, and FIG. 4 is a perspective view of the game sheet in folded form as shown in FIG. 1.

DETAILED DESCRIPTION

Referring to FIG. 1, it can be seen that the game apparatus 10 consists of a tee-shaped tethered ball device 11 comprising a handle portion 13, a crossmember portion 14, a cord 15 and a ball 16. The crossmember 14 may be removable and secured to handle 13 by conventional means; however, it is preferable that handle and crossmember be constructed in integral body form. The body can then be readily manufactured in wood, metal or plastic. In practice it was found that when molded in hollow plastic form the body was very light, durable and produced at a reasonable cost.

In accordance with the game function of device 11 the crossmember 14 is formed with an aperture 17 extending therethrough. Aperture 17 is centrally located in alignment with handle 13. Additionally, apertures 18 and 19 are disposed on the left hand and right hand side respectively of aperture 17. For identification purposes and reasons explained in more detail later the opening and area surrounding aperture 17 is colored blue. Likewise aperture 18 is red and aperture 19 is green. Handle 13 is colored blue to match aperture 17. The upper and lower edges 20 and 21 of aperture 17, 18 and 19 are bevelled outwardly so as to provide a target-like pocket for the passage of a spherical object therethrough. Also the diameter of the opening is made sufficiently larger than the spherical object, such as a ball, so that a ball can be dropped easily through the opening without binding on the interior wall of apertures 17, 18 or 19.

A cord 15 is fastened to crossmember 14 adjacent to centrally disposed aperture 17. Suspended on the other end of cord 15 is a ball 16 having a diameter less than the diameter of the opening in apertures 17, 18 and 19. Ball 16 is adapted to be cast outwardly in an arc and looped through the aforementioned apertures. Further, to enhance the skill required to perform the looping operation cord 15 and ball 16 are preferably constructed of an elastic or rubber-like material.

Referring to FIG. 3, there is to be seen a modified form of the tee-shaped device 11 in FIG. 2. The modified device 23 consists of a handle portion 24, a crossmember portion 25 integrally connected to a lesser handle portion 26 and spring element 27. Handle portion 24 is connected to lesser handle portion 26 of crossmember 25 by a spring element 27 which have opposite ends tightly inserted in handle portion 24 and lesser handle portion 26 of crossmember 25. Spring 27 induces flexibility in the handling of device 23 which is operationally different that in handling device 11 shown in FIG. 2. For this reason device 23 requires more skill and additional movement of wrist and arm to loop ball 16 in apertures 17, 18 and 19 which contributes to greater interest and fun in playing the game. Although spring 27 is incorporated in device 23 to induce a degree of flexible movement in crossmember 25 it may well be replaced by an elastic or rubber-like element for the same purpose. The rubber-like element is sufficiently elastic to cause crossmember 25 to bend in a downwardly movement as handle portion 24 is moved upwardly to cast ball 16 into the air. The parts of device 23 which are merely duplicated in FIG. 3 are designated by the same reference numerals used for device 11 shown in FIG. 2.

The game sheet 12 illustrated in FIG. 1 is arranged to be spread on the floor or any flat surface and walked on by player 28. The sheet is generally rectangular in shape and measures approximately five feet by seven feet. The top surface of sheet 12 is preferably colored white and may be made of paper, fabric or a vinyl-like plastic material. In the center of sheet 12 player 28 is seen standing on circular starting area 29 colored green. Intermediate area 29 and side 30 of sheet 12 is a smaller area or spot 31, colored blue, and displays a number thereon. In following order and led by arrows 32 it is seen that spot 33, colored green, is positioned on the upper left hand portion of side 30. Spot 34, colored orange and designated by the word "bonus", is located midway on side 35 and displays a number 5 thereon. Spots 36, colored red, and 37, colored blue, are located on the lower left hand and right hand portion respectively on side 38. A second "bonus" spot 39 is located midway on side 40 and the finishing spot 41 is located on the upper right hand portion of side 30.

The game is played in the following manner: Player 28 stands on starting area 29 holding the tee-shaped device 11 in his hand and is given a limited period of time to cast ball 16 into the air and loop it into the green colored aperture 19. To keep time a conventional timing device may be used and if successful in looping ball 16 in aperture 19 player 28 may proceed to the blue spot 31 which puts him in position to score. At this point player 28 is given 60 seconds, for example, to loop ball 16 through the blue aperture 17 to score one point.

If player 28 is not successful at the blue spot 31 another player takes his or her place on starting area 29 and tries to score. A player does not proceed from spot to spot until ball 16 is looped into the colored aperture corresponding to the color of spot he is standing on.

At player's next turn he may proceed to the next scoring spot if the previous spot has been scored.

When the player reaches the first bonus spot 34 he must loop ball 16 in apertures 18, 17 and 19 in that order within 60 seconds for a bonus of five points. If not successful on spot 34 he must wait for another turn on spot 36 and loses bonus chance of five points.

When player reaches the second bonus spot 39 he must again try to loop the ball in aperture 19, 17 and 18 in reverse order. Again if not successful he loses the bonus points and must wait for another turn on spot 41 to finish scoring the game. In keeping the total score any means may be used; however, a simple peg board having several rows of holes together with colored pins make it simple and easy to keep track of the score.

The program for playing the aforementioned game using the apparatus of the present invention is fun and highly interesting to the young and mature player as well. When the players develop more skill in operating device 11 and the modified form of device 23 the game can be made more exacting in that ball 16 must be looped first from the top side into apertures 17, 18 and 19 and then reversed from the bottom side upward through the same apertures.

From the description and illustration of the present invention it is obvious that it provides unique means for playing an exciting and moving game.

The foregoing description is to be clearly understood to be given by illustration and example only, the spirit and scope of the present invention being limited solely by the appended claims.

I claim:

1. A game apparatus, which comprises:

a tee-shaped body having a crossmember connected to a handle adapted to be held in the hand of a player, the crossmember further having at least one aperture extending therethrough, flexible means for connecting the handle to said crossmember, the flexible means being adapted to provide bending movement to said crossmember with respect to said handle, a cord having one end secured to the central portion of said crossmember, a ball secured to the other end of the cord and adapted to be cast into the air, and a game sheet for standing and walking thereon having an upper surface, the upper surface being imprinted with a starting area, intermediate standing areas and a finishing area, the object of the game being the requirement for casting the ball into the air and threading it through the aperture so as to afford the player an opportunity to move from the starting area to the finishing area.

2. The game apparatus as recited in claim 1, wherein the cord is an elastic band.

3. The game apparatus as recited in claim 1, wherein said ball is constructed of rubber-like material.

4. The game apparatus recited in claim 1, wherein the game sheet includes directional indicia thereon for translational movement of said player.

5. The game apparatus as recited in claim 1, wherein the flexible means comprises an elastic or rubber-like connector.

6. A game apparatus, which comprises:

a tee-shaped body having a lesser handle portion of a crossmaker flexibly coupled to a handle adapted for movement in the hand of a player, the crossmember further having at least one aperture extending therethrough centrally disposed in alignment with the handle, a spring element for coupling said handle to said crossmember, the spring being adapted to provide flexibility of movement to said crossmember with respect to said handle when said handle is moved in an upwardly motion, a cord having an end connected to the central portion of said crossmember, a ball connected to the other end of the cord and adapted to be cast into the air, and a game sheet for standing and walking thereon, the sheet having an upper surface delineated with a starting area, intermediate standing and scoring areas and a finishing area, the object of the game being the successive casting of the ball into the air and looping it through the aperture so as to afford the player an opportunity to move from the starting area to each scoring area and thence to the finishing area.

7. The apparatus recited in claim 1, wherein:

the spring element is coupled with one end inserted in said handle portion and the other end inserted in the lesser handle portion of said crossmember.

8. The apparatus recited in claim 7, wherein:

the cord is an elongate elastic band.

9. The apparatus recited in claim 8, wherein:

the ball consists of solid rubber-like material.

* * * * *